United States Patent [19]

Ito

[11] 4,426,835

[45] Jan. 24, 1984

[54] REEL HOLDER AND CLAMPING ARRANGEMENT FOR A STRANDER CRADLE ASSEMBLY

[75] Inventor: Rokuzo Ito, Toronto, Canada

[73] Assignee: Canada Wire and Cable Limited, Toronto, Canada

[21] Appl. No.: 354,061

[22] Filed: Mar. 2, 1982

[30] Foreign Application Priority Data

Jun. 4, 1981 [CA] Canada ..... 379004

[51] Int. Cl.[3] ..... D07B 7/06; D07B 3/02

[52] U.S. Cl. ..... 57/127.7; 57/65; 57/127.5; 242/129.6

[58] Field of Search ..... 57/65, 127.5, 127.7; 242/129.5–130

[56] References Cited

U.S. PATENT DOCUMENTS 2,860,479 11/1958 Wheater ..... 57/127.7 X
2,972,854 2/1961 Bruestle ..... 57/127.5 X
4,241,573 12/1980 Halasz et al. ..... 57/127.7

FOREIGN PATENT DOCUMENTS 1057142 6/1979 Canada .

*Primary Examiner*—John Petrakes
*Attorney, Agent, or Firm*—Fleit, Jacobson, Cohn & Price

[57] ABSTRACT

A reel holder and clamping arrangement for a strander cradle is disclosed. The reel holder and clamping arrangement comprises two pintle assemblies each incuding a bearing housing, a pintle rotatably mounted in the bearing housing and means for mounting each bearing housing in axial alignment one on each side frame member. First cam means are associated with at least one of the pintle assemblies for moving its associated pintle along the axis of the reel for clamping a reel between the pintles. A reel holder engages the flanges of the reel when the reel is received within the cradle for positioning the core of the reel in alignment with the pintles of the pintle assemblies. Second cam means are associated with at least one of the pintle assemblies for moving the reel holder out of engagement with the flanges of the reel when the reel is clamped between the pintles. Means are provided for simultaneous actuation of the first and second cam means to clamp the reel between the pintles and free the flanges of the reel from the reel holder.

10 Claims, 14 Drawing Figures

REEL HOLDER AND CLAMPING ARRANGEMENT FOR A STRANDER CRADLE ASSEMBLY

This invention relates to a reel holder and clamping arrangement for a strander cradle assembly.

As it is well known, cradle assemblies are used in cable stranding machines for the making of cables composed of a plurality of twisted wires or wire strands. There are two types of stranding machines, namely the tubular stranding machines and the planetary type stranding machines. The tubular stranding machines comprise a large tube within which a number of cradles are mounted on the same axis whereas the planetary stranding machines comprise a number of cradles mounted on axes parallel to the main axis of the machine. In both types of stranding machines, the reels are mounted on the cradles and such reels must be replaced when empty. It is important to safely clamp the reels in position as they are relatively heavy and could cause a lot of damage if they became loose in operation. A suitable reel clamp is disclosed in Canadian Pat. No. 1,057,142 which is assigned to the same assignee as the present application. It is also very important to be able to install a new reel rapidly.

It is therefore the object of the present invention to provide a reel holder and clamping arrangement which allows loading and clamping of a new reel in a minimum of time.

The reel holder and clamping arrangement, in accordance with the invention, comprises two pintle assemblies each including a bearing housing, a pintle rotatably mounted in the bearing housing and means for mounting each bearing housing in axial alignment one on each side frame member of the strander cradle, first cam means associated with at least one of the pintle assemblies for moving its associated pintle along the axis of the reel for clamping the reel between the pintles, a reel holder engaging the flanges of the reel when the reel is received within the cradle for positioning the core of the reel in alignment with the pintles of the pintle assemblies, second cam means associated with at least one of the pintle assemblies for moving the reel holder out of engagement with the flanges of the reel when the reel is clamped between the pintles, and means for actuating the first and second cam means to simultaneously clamp the reel between the pintles and free the flanges of the reel from the reel holder.

The means for mounting each bearing housing on its associated side frame member is preferably a cylinder having a flange secured to each side frame member. A ring having an eccentric cam surface is rotatably mounted on each flanged cylinder and the reel holder comprises a lifting plate having a cam surface engaging the eccentric cam surface of each ring and holding means attached to the lifting plates for engaging the flanges of the reel.

The first cam means preferably comprises a profiled groove cut in the circumference of the bearing housing of each pintle assembly over a predetermined length thereof, a cam roll engaging the groove and a cam roll holder connected to the above mentioned ring for rotating the cam roll around the axis of the pintle assembly to move the bearing housing with the pintle rotatably mounted therein axially within the core of the reel. The flanged cylinder has a groove of predetermined length cut perpendicularly in the wall thereof and the cam roll holder includes a pin which protrudes through such groove. The means for simultaneously actuating the first and second cam means is a lever connected to the above mentioned ring.

Each pintle includes a shaft journaled in bearings mounted in the bearing housing, a driving plate mounted coaxially with such shaft and adapted to engage the flange of the reel, and means for resiliently coupling the driving plate with respect to the pintle.

A brake plate is coupled to the shaft, a brake shoe mounted on the above mentioned flanged cylinder and resilient means mounted within the shaft for biasing the brake plate against the brake shoe so as to apply a continuous braking action on the reel.

The invention will now be disclosed, by way of example, with reference to the accompanying drawings in which.

Figure 4B:
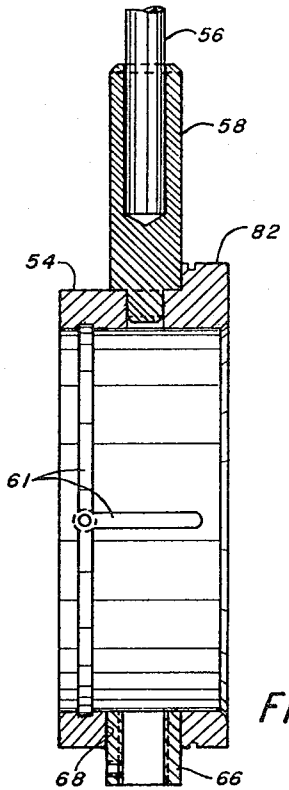
Figure 4A:
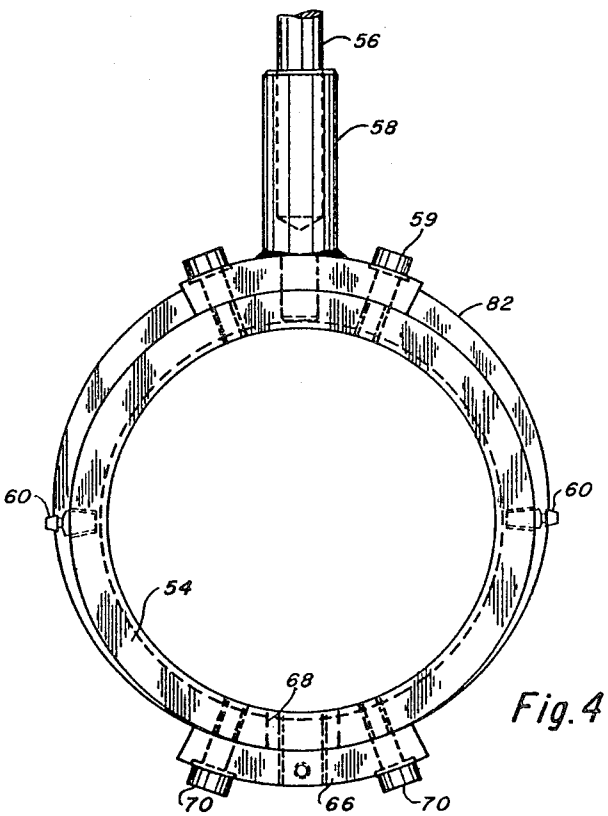
Figure 5:
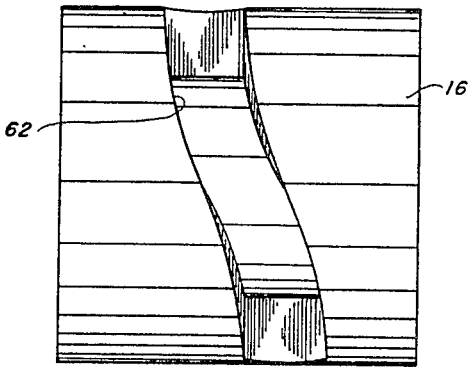
Figure 6:
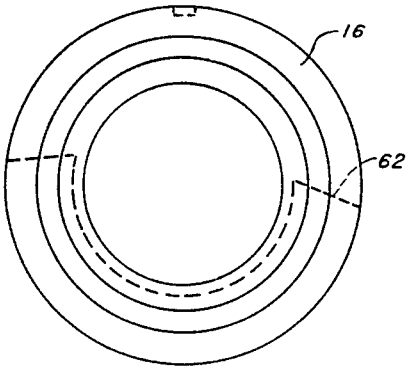
Figure 13:
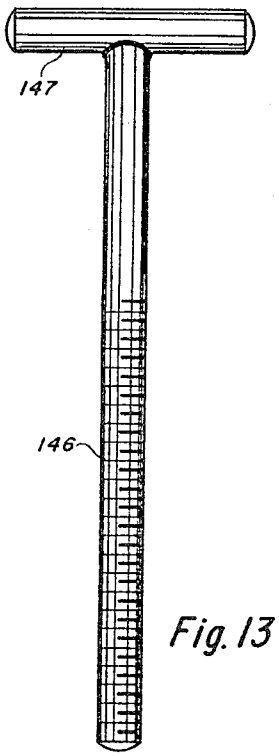
Figure 10:
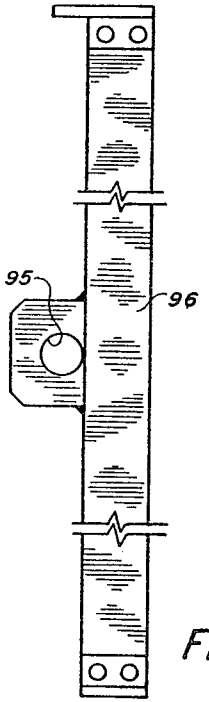
Figure 7:
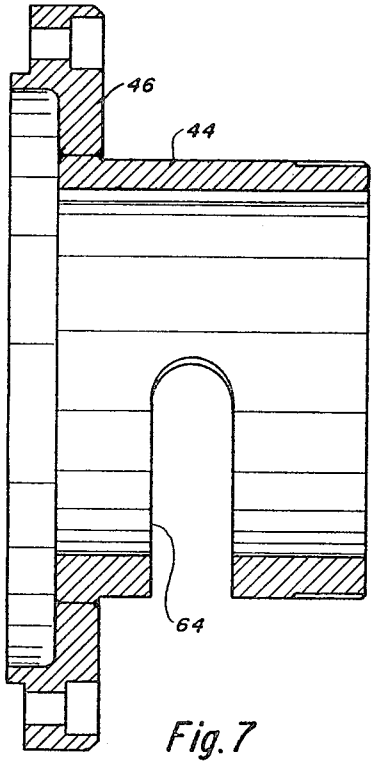
Figure 9:
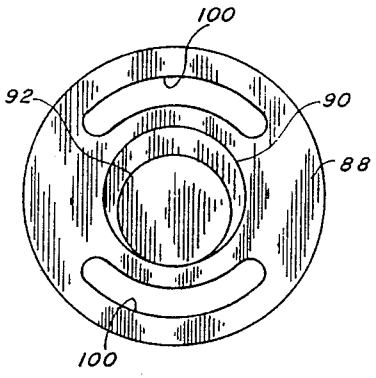
Figure 8:
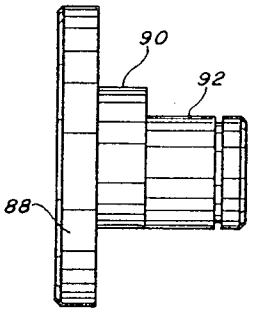
Figure 12:
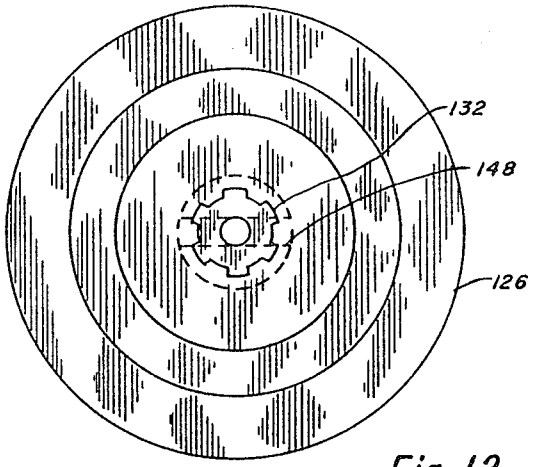
Figure 11:
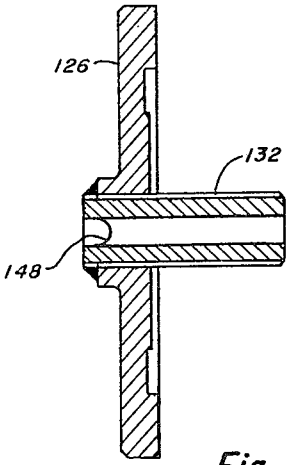

FIGS. 4*a* and 4*b* are side and section views, respectively, of an eccentric ring which forms part of the pintle assembly;

FIGS. 5 and 6 illustrate a plan and an end view, respectively, of a bearing housing which forms part of the pintle assembly;

FIG. 7 is a section view through a flanged cylinder forming part of the pintle assembly;

FIGS. 8 and 9 illustrate side and front views of an adjusting pin forming part of the cradle assembly;

FIG. 10 is a side view of a support bar forming part of the cradle assembly;

FIGS. 11 and 12 illustrate a section view and an end view, respectively, of a brake plate forming part of the cradle assembly; and FIG. 13 illustrates an adjusting bolt forming part of the brake assembly.

Figure 1:
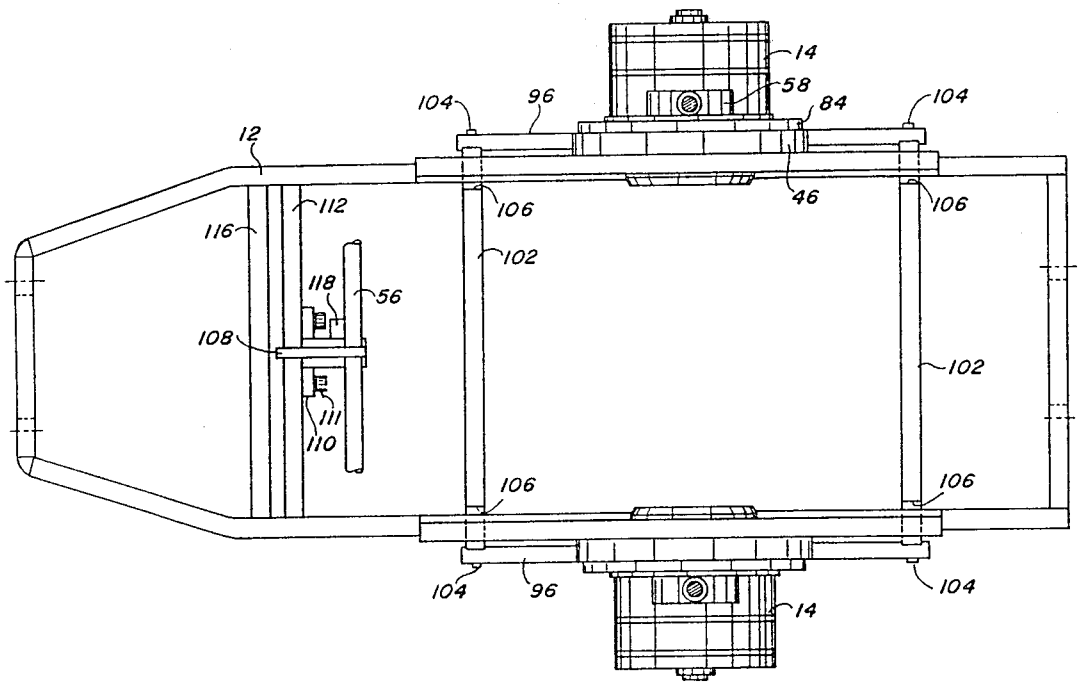
FIGS. 1 and 2 illustrate a plan and a side view, respectively, of a cradle assembly in accordance with the invention.
Figure 2:
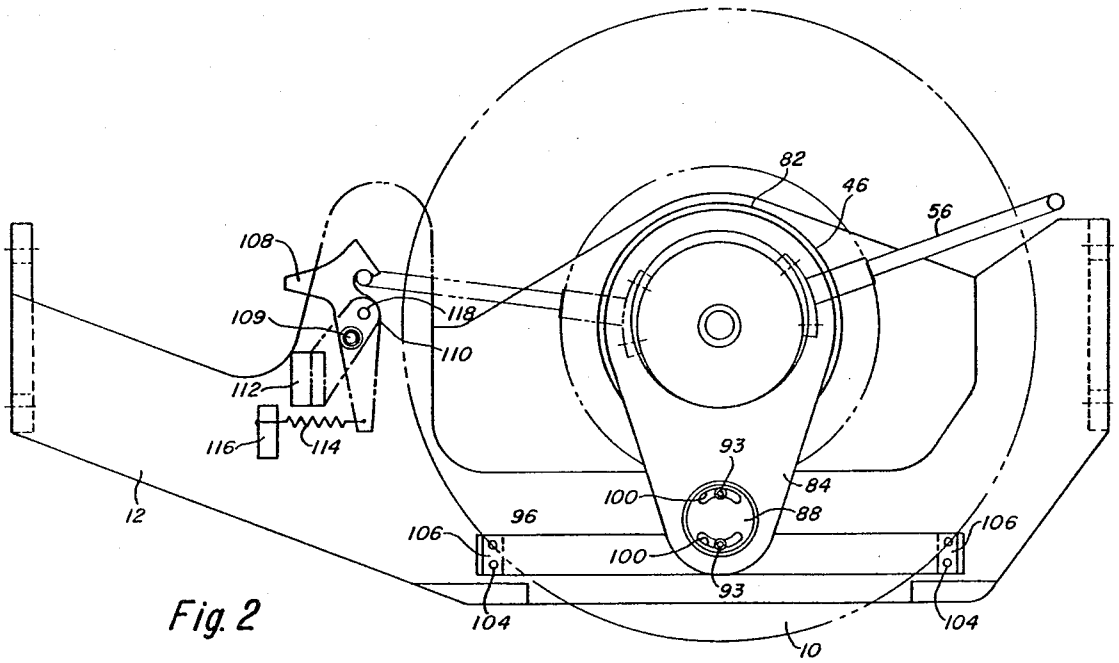

Referring to FIGS. 1 and 2, there is shown a cradle assembly for supporting a reel 10 in a tubular strander. The cradle assembly comprises a pair of side frame members 12 mounted for rotation in suitable bearing members (not shown) such as the ones illustrated in the above mentioned Canadian Pat. No. 1,057,142. The reel 10 is clamped between two pintle assemblies 14.

Figure 3:
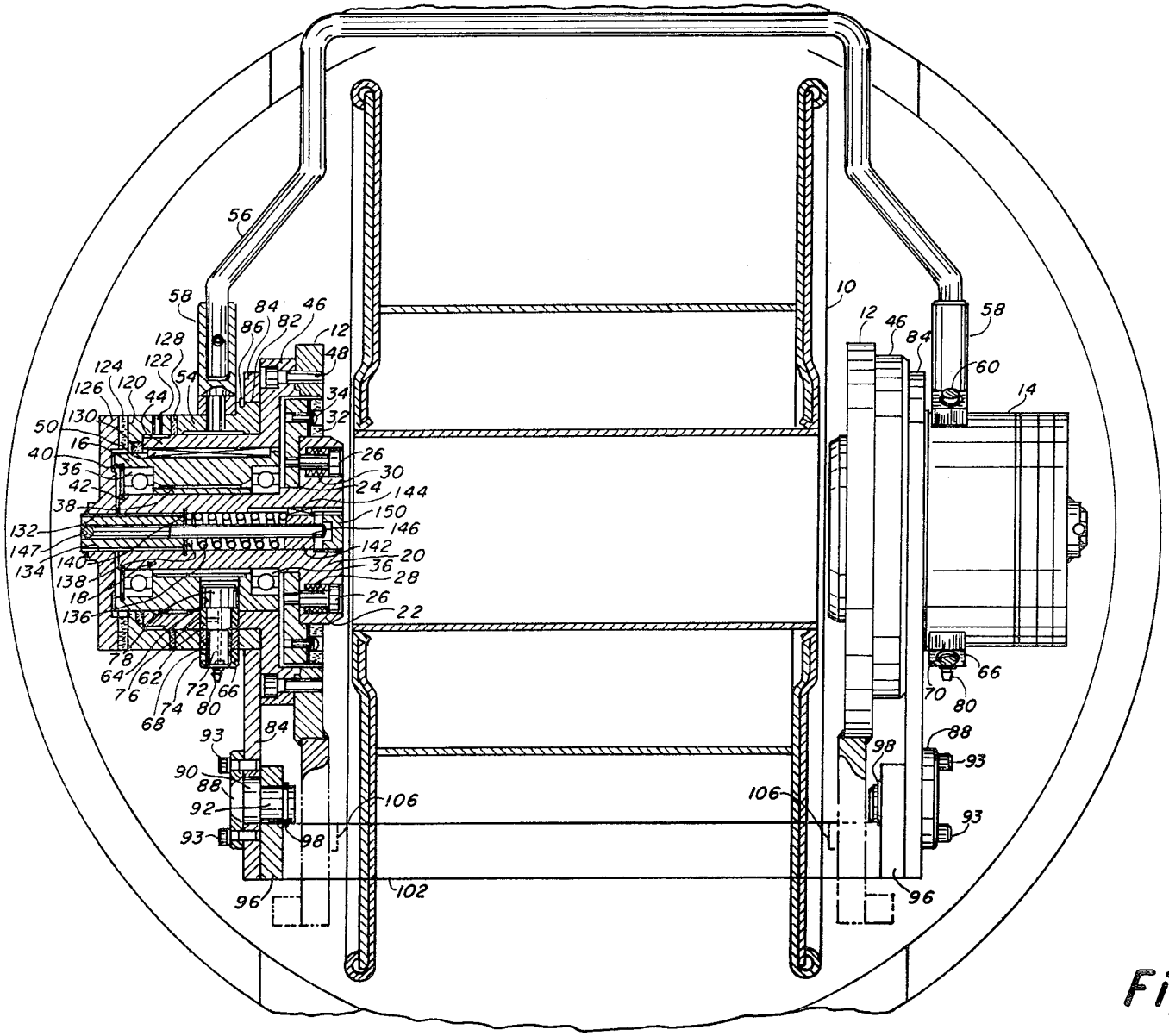
FIG. 3 illustrates a partial section view through the cradle assembly of FIG. 1.

Referring to FIG. 3, each pintle assembly includes a bearing housing 16 and a pintle 18 comprising a shaft 20 and a head 22 which forms a seat for the core of the reel 10. A driving plate 24 adapted to engage the flange of the reel 10 is mounted coaxially with shaft 20 and secured to the head of the pintle by means of guide bolts 26 which are threaded into the driving plate and have their heads slidably mounted in openings 28 in the driving plate. The driving plate is resiliently mounted on the shaft of the pintle by means of springs 30 located between the heads of the guide bolts and the bottom of the openings 28 in the head of the pintle. A rubber ring 32 is secured to the face of the driving plate by bolts 34 for engagement with the flange of the reel. Shaft 20 is journaled in bearings 36 which are located in bearing housing 16. A cylindrical spacer 38 separates the bearings 36 on shaft 20. The bearings are locked in position in housing 16 and on shaft 20 by retaining rings 40 and 42.

Each pintle assembly is mounted within a cylinder 44 having a flange 46 which is secured to the side frame 12 by means of bolts 48. Each pintle assembly is axially movable within its associated cylinder 44 but is prevented from rotating by means of key 50 engaging corresponding keyways in bearing housing 16 and cylinder 44. As shown more clearly in FIGS. 4*a* and 4*b*, a ring 54 is rotatably mounted on cylinder 44 and is operated by a lever 56 through a bracket 58 which is secured to such ring by bolts 59. Ring 54 is lubricated by grease fittings 60 and channels 61. As clearly seen in FIGS. 5 and 6, each bearing housing 16 has a groove 62 having a predetermined profile which extends over an angle of about 150° in the circumference of the bearing housing, thus forming a cam surface in the bearing housing. As shown more clearly, in FIG. 7, a groove 64 is cut into cylinder 44 perpendicular to its axis. As clearly seen in FIGS. 4*a* and 4*b*, a bracket 66 is mounted in an opening 68 in ring 54 and secured to ring 54 by means of bolts 70. A cam roll holder 72 is secured to bracket 66 by tap screw 74. The shaft of cam roll holder 72 passes through a bronze bushing 76 located in groove 64 of cylinder 44, and a cam roll 78, engaging groove 62 in bearing housing 16, is journaled in the end of the cam roll holder. The cam roll 78 and bushing 76 are lubricated by a grease fitting 80 through suitable channels in the shaft of cam roll holder 72. Rotation of the ring 54 through an angle of about 150° thus moves the cam holder 72 within groove 64 in flanged cylinder 44 and causes the cam roll 78 to engage the cam surface of groove 62 in the bearing housing to move the pintle axially in and out of the core of the reel.

Referring to FIGS. 3, 4*a* and 4*b*, each ring 54 is also provided with an eccentric cam surface 82. A lifting plate 84, which is also shown in FIG. 2, engages the eccentric cam surface 82 and is moved up and down a distance corresponding to the off-center of the eccentric cam surface 82 during rotation of the ring 54 by lever 56. The lifting plate 84 is locked against axial movement on the cam surface 82 by retaining ring 86. An adjusting pin 88, having two eccentric circular cam surfaces 90 and 92, as shown in FIGS. 8 and 9, is secured to the lower end of each lifting plate 84 by bolts 93. The circular cam surface 90 engages a corresponding circular opening in the lifting plate 84 and the circular cam surface 92 engages a corresponding circular opening 95 in a support bar 96 which is shown in FIG. 10 of the drawings. The support bar 96 is locked on the adjusting pin by retaining ring 98. The head of adjusting pin 88 is provided with two circular slots 100, as shown in FIGS. 2 and 9, allowing rotation of the pins 88 and adjustment of the vertical position of the support bars through the camming action of each surfaces 90 and 92. Transverse holder bars 102 are secured between the corresponding ends of each support bar 96 by means of bolts 104. The holder bars have diagonal slots 106 engaging the flanges of the reel when lowered between the pintles prior to clamping. It will be seen that adjustment of the vertical position of the support bars 96 permits to adjust the height of the holder bars 102 to suit variations in reel flange diameter.

As shown in FIGS. 1 and 2, the lever 56 is moved manually from the position shown in full line to the position shown in dashed lines during clamping of the reels. The lever is locked in position by locking device 108 pivotally mounted at 109 on a bracket 110 secured by bolts 111 to a transverse member 112 itself secured across side frame members 12. The locking device 108 is biased clockwise by a spring 114 having one end secured to the locking device and its other end secured to a transverse member 116 itself secured across side frame members 12. A stopper 118 is mounted on the bracket 110 for arresting the swinging movement of bar 56.

Referring back to FIG. 3, each pintle assembly is provided with a brake assembly comprising a brake shoe 120 secured to the end of flanged cylinder 44 by tap screw 122, a brake lining 124 and a brake plate 126. The brake shoe is separated from the rotatable ring 54 by a bronze spacer 128 and from the end of cylinder 44 by a felt ring 130. The brake plate has a shaft which is provided with circumferential splines 132, as shown in FIGS. 11 and 12 for engaging corresponding splines in a central opening 134 of the pintle so as to permit coupling of the pintle with the brake plate while allowing longitudinal movement of the pintle during clamping and unclamping of the reel. The braking torque is applied on the brake plate by means of a spring 136 having one end contacting a washer 138 which engages an abutment ring 140 mounted in a slot within the central opening 134 of the pintle, and its other end engaging a slide block 142 which is axially movable within the central opening 134 of the pintle but is prevented from rotating by means of a key 144 engaging corresponding slots in the slide block and in the central opening of the pintle. Slide block 142 has a central threaded opening which is engaged by the threaded end of an adjusting bolt 146 having a head 147 in the shape of a T, adapted to engage a slot 148 in the hub of the brake plate as shown in FIGS. 3, 11 and 13. The tension of the spring and thus the braking torque applied to the brake plate may be adjusted by tightening or loosening the bolt 146. It will also be noted that the spring is more heavily compressed when the pintle is moved within the core of the reel thus increasing the braking action applied on the reel. The central opening in each pintle is closed by a plug 150 to prevent dust and dirt from getting into the opening.

The operation of the reel holder and clamping arrangement may be best understood with reference to FIGS. 1 and 2. When it is desired to remove an empty reel, the locking device 108 is rotated anti-clockwise and lever 56 is then freed and rotated clockwise by about 150° from the position shown in dashed line in FIG. 2. Lever 56 rotates ring 54 on the flanged cylinder 44 of both pintle assemblies. Ring 54 rotates the cam roll holder 72 and in so doing, the cam roll 78 of each pintle assembly rides in the cam surface of groove 62 of each bearing housing 16 to move the pintles 18 out, thus freeing the reel. Simultaneously, the cam surfaces 82 of rings 54 cause the lifting plates 84 to raise and the holder bars 102 to contact the flanges of the empty reel. The empty reel can then be taken out and a full one put back on the holder bars 102. In such position the core of the new reel is in alignment with the pintles and the lever 56 may be operated in the opposite direction to clamp the new reel in position. In moving back the lever 56, the cam surfaces 82 of rings 54 cause the lifting plates 84 to move down and free the flanges of the new reel to allow rotation of the reel.

Although the invention has been disclosed with reference to a preferred embodiment, it is to be understood that it is not limited to such embodiment and that various alternatives are envisaged within the scope of the appended claims.

I claim:

1. A reel holder and clamping arrangement for a strander cradle having a pair of side frame members comprising:

(a) two pintle assemblies each including a bearing housing, a pintle rotatably mounted in said bearing housing and means for mounting each bearing housing in axial alignment one on each side frame member;

(b) first cam means associated with at least one of said pintle assemblies for moving its associated pintle along the axis of a reel for clamping a reel between the pintles;

(c) a reel holder engaging the flanges of the reel when the reel is received within the cradle for positioning the core of the reel in alignment with the pintles of the pintle assemblies;

(d) second cam means associated with at least one of said pintle assemblies for moving the reel holder out of engagement with the flanges of the reel when the reel is clamped between the pintles; and (e) means for actuating said first and second cam means to simultaneously clamp the reel between the pintles and disengage the reel holder from the flanges of the reel.

2. A reel holder and clamping arrangement as defined in claim 1, wherein said means for mounting each bearing housing on its associated side frame member is a cylinder having a flange secured to each side frame member.

3. A reel holder and clamping arrangement as defined in claim 2, wherein said second cam means comprises a ring rotatably mounted on each flanged cylinder and having an eccentric cam surface, and wherein said reel holder comprises a lifting plate having a surface engaging the eccentric cam surface of said ring, and holding means mounted on the lifting plates for engaging the flanges of the reel.

4. A reel holder and clamping arrangement as defined in claim 3, wherein said holding means is a support bar mounted parallel to each lifting plate at the lower end of the lifting plates, and holder bars secured to each end of said support bars and joining the support bars together.

5. A reel holder and clamping arrangement as defined in claim 3, wherein said first cam means comprising a profiled groove cut in the circumference of the bearing housing of each pintle assembly over a predetermined length thereof, a cam roll engaging said groove, and a cam roll holder connected to said ring for rotating said cam roll around the axis of the pintle assembly for moving the bearing housing with the pintle rotatably mounted therein axially within the core of the reel.

6. A reel holder and clamping arrangement as defined in claim 5, wherein said flanged cylinder has a groove of predetermined length cut perpendicularly in the wall thereof, and wherein said cam roll holder includes a pin which protrudes through said groove.

7. A reel holder and clamping arrangement as defined in claim 6, wherein said means for simultaneously actuating said first and said second cam means is a lever connected to said ring.

8. A reel holder and clamping arrangement as defined in claim 7, wherein said lever is coupled to both rings for simultaneous rotation of both rings.

9. A reel holder and clamping arrangement as defined in claim 2, wherein each pintle includes a shaft journaled in bearings mounted in said bearing housing, a driving plate mounted coaxially with said shaft and adapted to engage the flange of the reel, and means for resiliently coupling said driving plate with respect to said pintle.

10. A reel holder and clamping arrangement as defined in claim 9, further comprising a brake plate coupled to said shaft, a brake shoe mounted on said flanged cylinder, and resilient means mounted within said shaft for biasing said brake plate against said brake shoe.

* * * * *